US011255035B2

(12) United States Patent
Chae et al.

(10) Patent No.: US 11,255,035 B2
(45) Date of Patent: Feb. 22, 2022

(54) LAUNDRY APPARATUS

(71) Applicant: LG Electronics Inc., Seoul (KR)

(72) Inventors: Aekyung Chae, Seoul (KR); Keunjoo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 112 days.

(21) Appl. No.: 16/387,798

(22) Filed: Apr. 18, 2019

(65) Prior Publication Data

US 2019/0323159 A1 Oct. 24, 2019

(30) Foreign Application Priority Data

Apr. 18, 2018 (KR) ..... 10-2018-0045252

(51) Int. Cl.
*D06F 37/24* (2006.01)
*D06F 29/00* (2006.01)
*D06F 39/12* (2006.01)

(52) U.S. Cl.
CPC ..... *D06F 37/24* (2013.01); *D06F 29/00* (2013.01); *D06F 39/125* (2013.01)

(58) Field of Classification Search
CPC ..... D06F 37/24; D06F 29/00; D06F 39/125
USPC ..... 68/3 R
See application file for complete search history.

(56) References Cited

U.S. PATENT DOCUMENTS 6,397,643 B1 * 6/2002 Chang ..... D06F 37/24 68/23.1
2014/0053612 A1 * 2/2014 Son ..... D06F 31/00 68/28
2015/0191860 A1 7/2015 Sim et al.

FOREIGN PATENT DOCUMENTS

| | | |
|---|---|---|
| EP | 2700743 | 2/2014 |
| EP | 2980297 | 2/2016 |
| KR | 200146585 | 2/1999 |
| KR | 1020050117003 | 12/2005 |
| KR | 1020140026802 | 3/2014 |
| KR | 1020140026802 | 6/2014 |
| KR | 1020160007276 | 1/2016 |

OTHER PUBLICATIONS

KR20140026802A—Machine translation (Year: 2014).*
Extended European Search Report in European Application No. 19168621.1, dated Jul. 5, 2019, 8 pages.

* cited by examiner

*Primary Examiner* — Tinsae B Ayalew
(74) *Attorney, Agent, or Firm* — Fish & Richardson P.C.

(57) ABSTRACT

A laundry apparatus includes a housing; a tub; a drum rotatably located in the tub and configured to receive clothes; a drive unit configured to rotate the drum; and a plurality of support units located at the housing and configured to support the tub and to reduce vibration of the tub. Each of the plurality of support units extends in a direction parallel to a height direction of the tub and includes a first support portion located at the tub, a second support portion located at the housing vertically above the first support portion, a connection portion that connects the first support portion and the second support portion to each other, and a reinforcement unit that is configured to contact a surface of the connection portion and that is configured to restrict variation of a position of the connection portion.

20 Claims, 9 Drawing Sheets

LAUNDRY APPARATUS

CROSS-REFERENCE TO RELATED APPLICATIONS

This application claims priority to Korean Patent Application No. 10-2018-0045252, filed on Apr. 18, 2018, the entire contents of which are hereby incorporated by reference in their entirety.

TECHNICAL FIELD

The present disclosure relate to a laundry apparatus, particularly, a laundry apparatus of which a suspension provided to support a tub may damp vibration effectively.

BACKGROUND

Generally, a laundry apparatus can include an apparatus adapted to wash laundry, an apparatus adapted to dry laundry, and an apparatus adapted to perform both washing and drying of laundry. Here, the laundry apparatus may perform only a washing or drying function or both of the functions. Recently, a steam supply device is provided in such the laundry apparatus such that the laundry apparatus may include a refresh function configured to remove wrinkles, bad smell and static electricity from clothes.

Such the laundry apparatus tends to be large-sized in response to user's demands. In other words, even the washing machines for family use is becoming larger Each family purchases and uses one large-capacity laundry apparatus. Thus, when desired to sort the laundry according to the type of fabric, a user has to use the large-capacity laundry apparatus several times. As one example, when trying to sort laundry into a laundry group for clothes adults and another laundry group for lingerie or infant clothes before washing, the user has to use the laundry apparatus for the former group and then use it again for the latter group.

Accordingly, it takes much time and much energy to performing the total washing processes disadvantageously. In addition, it is not preferred to wash a small amount of laundry in the conventional large laundry apparatus in terms of energy saving.

Because of that, there are increasing demands for a much smaller-capacity laundry apparatus than the conventional large-capacity one. Recently, to solve the disadvantages, a small top load type laundry treatment is released to be additionally provided under the front load type laundry apparatus or independently provided.

Such the top load type laundry apparatus may be provided on a top of the front load type laundry apparatus or under the bottom of the front load type laundry apparatus as a drawer type. Such the top load type laundry apparatus may not only wash a small amount of laundry and make better use of space but also save water or energy and wash a small amount of laundry frequently.

However, the top load type laundry apparatus used as the auxiliary (or second) laundry apparatus has a relatively low height such that it may have quite a small space between a tub and a housing accommodating the tub to secure a washing capacity. Accordingly, when the tub is vibrating, the tub is likely to collide against a cabinet, different from the conventional top load type laundry apparatus. Also, there is a small space between the tub and the cabinet in the conventional laundry apparatus such that it may be difficult to apply a suspension including a conventional spring to the conventional laundry apparatus.

In addition, as the capacity and washing volume required in the auxiliary (second) laundry apparatus becomes expanded, the load applied to the conventional suspension structure might become larger disadvantageously.

Accordingly, it may be necessary to invent a top load type laundry apparatus which may effectively damp the vibration of the tub, even without the spring.

In addition, the conventional laundry apparatus could not secure safety disadvantageously if the suspension supports the tub applied more load.

Also, the convention suspension structure could not damp a vertical vibration of the tub having the larger load disadvantageously.

SUMMARY

Accordingly, an object of the present invention is to address the above-noted and other problems and provide a laundry apparatus which includes a suspension (hereinafter, a support unit) configured to damp vibration of a tub having the height smaller than the width effectively.

Another object of the present invention is to provide a laundry apparatus which includes a support portion configured to damp the vibration of the tub as other means than a spring damper.

A further object of the present invention is to provide a laundry apparatus which includes a reinforcement portion configured to stably support without any change of structure, even if the weight or capacity of the tub increases.

A further object of the present invention is to provide a laundry apparatus which may effectively damp the longitudinal-direction abnormal vibration generated by the increased weight or capacity of the tub.

A further object of the present invention is to provide a laundry apparatus which may immediately damp vibration by reinforcing a static electricity of a support unit.

Embodiments of the present disclosure may provide a laundry apparatus comprising a housing; a tub mounted in the housing and configured to hold water; a drum rotatably provided in the tub and configured to hold clothes; a drive unit provided in a lower area of the tub and configured to rotate the drum; and a plurality of support units provided in the housing to support the tub and configured to damp the vibration of the tub, wherein the height of the tub is larger than the width, and the support unit is arranged in parallel with the height direction of the tub, and the support unit comprises a first support portion provided in the tub; a second support portion provided in the housing and an upper area of the first support portion; a connection portion provided to connect the first support portion and the second support portion with each other; and a reinforcement unit provided to prevent the position of the connection portion from being variable by contacting or causing friction with a surface of the connection portion.

The connection portion may comprise a first connection portion coupled to the first support portion to support the first support portion; a second connection portion coupled to the second support portion to support the second support portion; and a connection bar provided to connect the first connection portion and the second connection portion with each other, and the reinforcement unit may prevent the position of at least one of the first and second connection portions coupled to the connection bar from being variable.

The reinforcement unit may comprise a friction material that contacts with an outer circumferential surface of the connection bar; and a reinforcing pocket comprising an accommodating space for accommodating the friction material.

The reinforcing pocket may be provided in an inner circumferential surface of the first or second connection portion.

The laundry apparatus may further comprise a cover coupled to the reinforcing pocket and configured to prevent the discharging of the friction material, wherein the reinforcing pocket is provided in at least one of an upper area of the first connection portion and a lower area of the second connection portion.

The cover may be coupled to the reinforcing pocket, penetrating the connection bar.

The reinforcing pocket may be extended from at least one of an upper end of the first connection portion and a lower end of the second connection portion to accommodate the connection bar.

The laundry apparatus may further comprise a cover coupled to the reinforcing pocket and configured to prevent the discharging of the friction material, wherein a diameter of the reinforcing pocket is larger than a diameter of the upper end of the first connection portion and a diameter of the lower end of the second connection portion.

The connection bar may penetrate the first connection portion and the second connection portion, and the reinforcing pocket may be provided in a lower area of the first connection portion or an upper area of the second connection portion.

The connection portion may comprise a first coupling portion coupled to the lower area of the first connection portion; a second coupling portion coupled to the upper area of the second connection portion, and the first coupling portion and the second coupling portion may be in close contact with the first connection portion and the second connection portion, respectively, to prevent the discharging of the friction material.

The friction material may be filled in the reinforcing pocket to one surface of at least one of the first and second coupling portions.

The reinforcement unit may comprise one or more dampers coupled to an outer circumferential surface of the connection bar; and a case coupled to the connection bar and provided to accommodate the one or more dampers.

The support unit may further comprise a third support portion projected from the tub or the housing and configured to accommodate the reinforcement unit.

The third support portion may be provided between the first support portion and the second support portion, and fixedly coupled to the reinforcement unit to prevent the reinforcement unit from being moved upwardly or downwardly.

According to embodiments of the present disclosure, the laundry apparatus in accordance may include a suspension (hereinafter, a support unit) configured to damp vibration of a tub having the height smaller than the width effectively.

Furthermore, the laundry apparatus may a support portion configured to damp the vibration of the tub as other means than a spring damper.

Still further, the laundry apparatus may include a reinforcement portion configured to stably support without any change of structure, even if the weight or capacity of the tub increases.

Still further, the laundry apparatus is capable of effectively damping the longitudinal-direction abnormal vibration generated by the increased weight or capacity of the tub.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and wherein.

DETAILED DESCRIPTION

Description will now be given in detail according to exemplary embodiments disclosed herein, with reference to the accompanying drawings. For the sake of brief description with reference to the drawings, the same or equivalent components may be provided with the same reference numbers, and description thereof will not be repeated.

The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Figure 1:
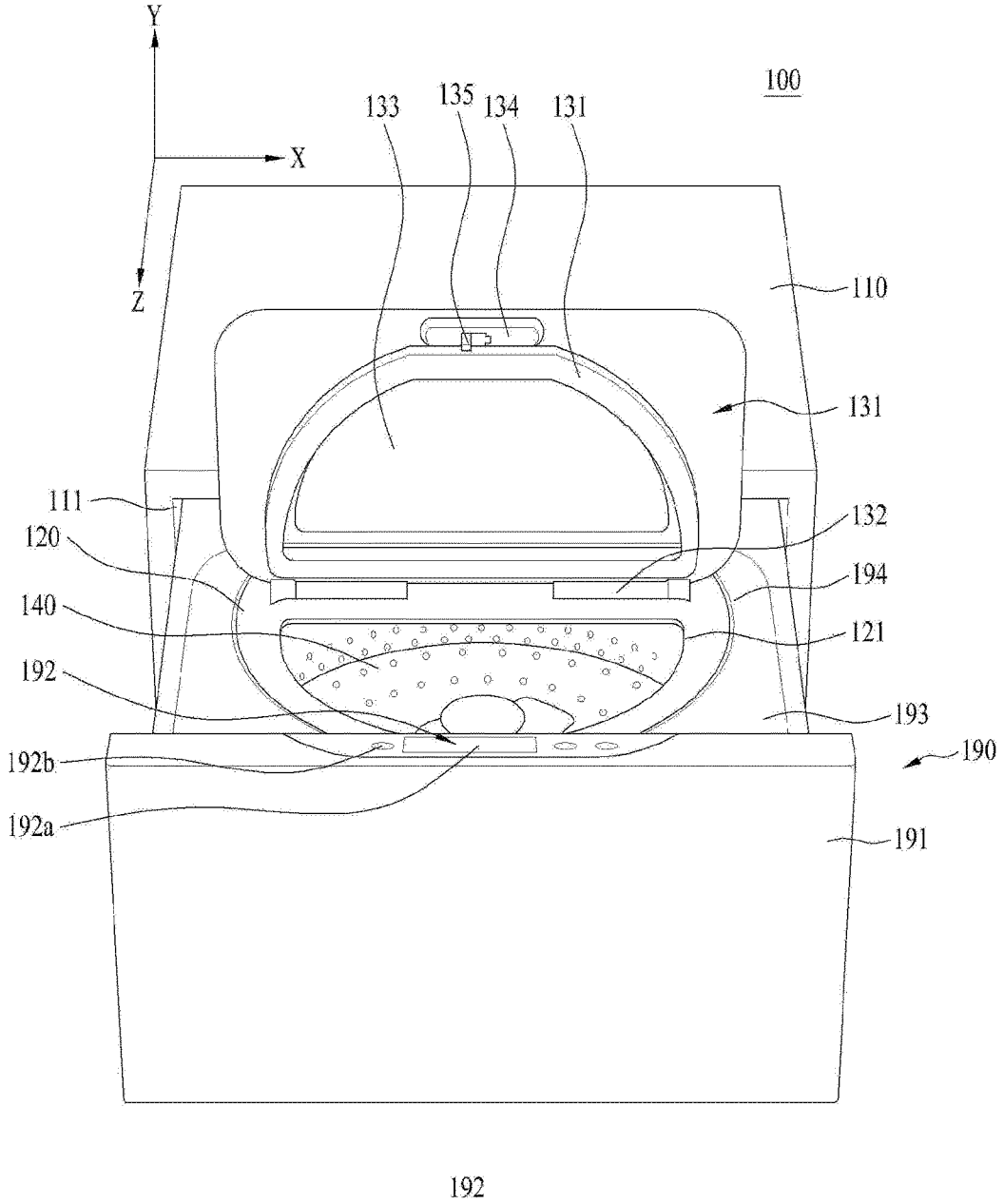
FIG. 1 is a diagram illustrating an exterior design of a laundry apparatus.
Figure 2:
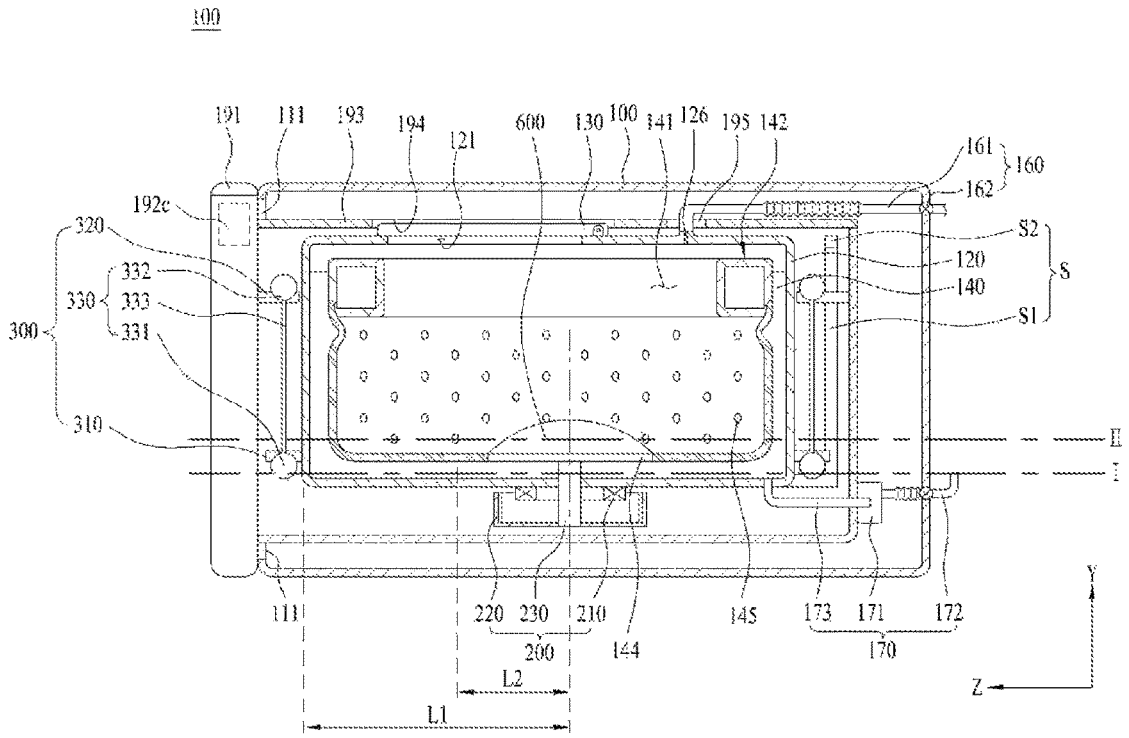
FIG. 2 is a diagram illustrating an inner structure of the laundry apparatus.

FIG. 1 is a diagram illustrating an exterior design of a laundry apparatus and FIG. 2 is a sectional diagram illustrating an inner structure of the laundry apparatus.

As shown in FIGS. 1 and 2, one embodiment of the laundry apparatus may be defined as a top load type laundry apparatus 100. In this instance, the front load type laundry apparatus has an introduction opening formed in a front side and a shaft of a drum oriented in parallel with the ground or tilted a preset angle. A top load type laundry apparatus may be defined as a laundry apparatus including an introduction opening formed in a top side; and a shaft of a drum vertically oriented with respect to the ground.

Referring to FIG. 1, the embodiment of the laundry apparatus 100 may include a cabinet 110 provided to define an exterior design; a tub 120 provided in the cabinet 110 and configured to hold water; and a drum 140 rotatably mounted in the tub 120 and configured to hold clothes.

The tub 120 may have an introduction opening 121 provided in a top or top surface to introduce clothes. The drum 140 may include a drum introduction opening 141 to load clothes in communication with the introduction opening 121.

Meanwhile, the laundry apparatus 100 may be used as an auxiliary laundry apparatus and mounted on a top or a bottom of a main laundry apparatus. Accordingly, each of the tub 120 and the drum 140 of the laundry apparatus 100 may have the height that is smaller than the width. In other words, the heights of the tub 120 and the drum 140 may be shorter than the diameters thereof.

As one alternative example, the laundry apparatus 100 may be provided as a drawer type so as to have a main laundry apparatus or another auxiliary laundry apparatus mounted on a top.

In this instance, the laundry apparatus 100 may further include an opening 111 formed in a front of the cabinet 100 and a drawer 190 that is able to be drawn out or in the cabinet 110 via the opening 111.

The tub 120 may be provided in the drawer 190 to be movable together with the drawer 190 when the drawer 190 is withdrawn or inserted.

The drawer 190 may include a front panel 191 provided to open and close the opening 111 of the cabinet 110; and a case 193 coupled to a rear side of the front panel 191 to accommodate the tub 120.

The case 193 may be provided in a cube shape and have an open area 194 provided in an upper surface, in communication with the opening 121.

In this instance, the laundry apparatus 100 may include a control panel 192 configured to input a command implemented to operate the laundry apparatus or display a current state.

The control panel 192 may be provided in an upper area of the front panel 192 or a predetermined area of the cabinet 110 unless the drawer 190 is provided.

The control panel 192 may include a display unit 192*a* configured to display a current state of the laundry apparatus; an input unit 192*b* configured to receive an operation command of the laundry apparatus; and a control unit 192*c* implemented to control the operation of the laundry apparatus.

The display unit 192*a* may include a display panel (e.g., LCD, LED and the like) and a speaker configured to generate sounds to deliver information to the user. In other words, the display unit 192*a* may display the information about the laundry apparatus to the user and sound an alarm if an alarm is needed.

Meanwhile, the height of the tub 120 provided in the laundry apparatus 100 is relatively lower than the width such that the water or clothes or washing detergent supplied to the tub 120 could be discharged via the introduction opening 121.

To prevent such discharge, the laundry apparatus 100 may further include a door 130 to open and close the introduction opening 121. The door 130 may be rotatably coupled to the housing 193 or an upper surface of the tub 120 to open and close the introduction opening 121.

The door 130 may include a frame 131 provided in a corresponding shape to the introduction opening 121; a window 133 provided in the frame 131 and allowing the user to check the inside of the tub 120; and a securing unit 135 provided to secure the closed state when the frame and the window closes the introduction opening 121.

A handle 134 may be provided in the securing unit 135 to facilitate the user's easy opening of the door.

The door 130 may further include a door body extended from an outer circumferential surface of the frame 131 to minimize the closing effect of the introduction opening 121.

FIG. 1 illustrates that the laundry apparatus is the drawer type to put into consideration that it may be provided under the main laundry apparatus as the auxiliary (or second) laundry apparatus. However, the laundry apparatus may be a conventional top load type laundry apparatus, not the drawer type.

Accordingly, the tub 120 may be mounted in the cabinet 110 or in the drawer 190. In other words, the cabinet 110 and the drawer 190 may accommodate the tub 120 such that they may be referred to as 'the housing'.

Referring to FIG. 2, the laundry apparatus 100 may include a water supply unit 160 provided to supply water to the tub 120; and a water discharge unit 170 provided to discharge the water from the tub 120.

The water supply unit 160 may include a water supply pipe 161 for supplying water from an external water supply source; and a water supply valve 162 provided to determine the opening and closing of the water supply pipe 161.

The water discharge unit 170 may include a water discharge pipe 173 through which the water is discharged from the tub 120, in communication with a bottom of the tub 120; a water discharge pump 171 provided to provide the power for discharging the water from the water discharge pipe 173 outside the cabinet 110; and an outlet pipe 172 provided to exhaust the water from the tub outside the cabinet 110, in communication with the water discharge pump 171.

Meanwhile, the laundry apparatus 100 may further include a support unit 300 provided to support the tub 120 at the cabinet 110 or the drawer 190 and damp the vibration generated in the tub 120 from being transmitted to the cabinet 100.

The support unit 300 may be provided as a damper or spring or the combination of the damper and spring or a plurality of dampers and springs. However, if the support unit 300 is provided relatively low, it could be difficult to install the spring in the support unit 300 and it is preferred the spring is omitted.

The support unit 300 may be provided in an upper or lower portion of the tub 120 or both of the upper and lower portions. However, the laundry apparatus 100 may be provided as the auxiliary laundry apparatus and the total height of the laundry apparatus may be limited. Accordingly, the support unit 300 may be provided in a lateral surface of the tub 120.

The support unit 300 may include a second support portion 320 provided in an inner surface of the cabinet 110 or the drawer 190 (hereinafter, the housing); a first support portion 310 provided beyond the second support portion outside the tub 120; and a connection portion 330 provided to connect the first support portion 310 and the second support portion 320 with each other.

The first support portion 310 may be provided lower than the second support portion 320 and the connection portion 330 has one end coupled to the first support portion 310 to support the first support portion and the other end fixedly coupled to the second support portion 320.

The second support portion 320 may be a second bracket projected from the cabinet 110 or the drawer 190. The first support portion 310 may be a first bracket projected from the tub 120. The connection portion 330 may connect the first bracket and the second bracket with each other. At this time, the connection portion 330 maybe provided in parallel with the height of the drum 140 with respect to the bottom surface 144 of the drum 140. That is to minimize the volume occupied by the support portion 300 including the connection portion 330 so as to expand the washing volume of the tub 120.

The connection portion 330 may include a first connection portion 331 supporting through the first support portion 310; a second connection portion 332 connecting through the second support portion 320; and a connection bar 333 connecting the first and second connection portions 331 and 332 with each other.

The first connection portion 331 and the second connection portion 332 have larger diameters than the connection bar 333 and each of them may be provided in a disc, a hemisphere or a sphere shape. Accordingly, the connection portion 330 may be coupled to the first support portion 331 and the second support portion 332 stably.

Meanwhile, a water level sensor S may be provided in a predetermined area of the tub 120 to sense a water level of the tub 120. A temperature sensor may be provided in an inner circumferential surface of the tub 120 to sense the temperature of the tub 120.

The water level sensor S may include a sensor pipe S1 extended to an upper area of the tub 120, in communication with one side of the tub 120; and a diode S2 having the sensor pipe provided thereon to sense the internal pressure of the sensor pipe. The water sensor S may be provided in any shapes or structures only if it can measure the water level of the tub 120.

The water level sensor S is able to sense whether the water level reaches a first water level I that is corresponding to the bottom surface 144 of the drum and whether the water level reaches a second water level II that is corresponding to an agitation unit 600 which will be described later.

The first water level I may be corresponding to a water level between the bottom surface 127 of the tub and the bottom surface 144 of the drum. The second water level may be corresponding to a water level between the bottom surface 144 of the drum and the agitation unit 600. Specifically, the second water level II may be defined as a water level at which the agitation unit 600 is exposed to air.

In this instance, the laundry apparatus 100 may include a drive unit 200 configured to rotate the drum 140 in the tub 120.

The drive unit 200 may include a stator fixed to the bottom surface 127 of the tub 120 and configured to generate a rotation magnetic field; a rotor 220 rotary by the rotation magnetic field of the stator; and a shaft 230 rotatable by the rotor through the tub.

The drum 140 may include the drum opening 141 in communication with the introduction opening 121. The drum 140 may include a balancer 142 coupled to an outer circumferential surface of the drum opening 141 to prevent eccentricity of the drum 140.

In one embodiment, the drum 140 may include a plurality of hollows 145 provided to draw or discharge the water of the tub.

The drum 140 may be rotatable by the power provided by the drive unit 200 and perform washing by applying a mechanical force to the clothes held in the drum 140.

In addition, the drum 140 may be rotated by the power of the drive unit 200 and actuate a spin cycle configured to discharge the moisture contained in the clothes via the hollows 145.

At this time, the drum bottom surface 144 may include a through hole 144*a* and the agitation unit 600 may be rotatably coupled to the through hole 144*a*.

The agitation unit 600 may be rotatable, independent from the drum 140, to agitate the clothes. In other words, the agitation unit 600 may apply the mechanical force to the clothes held in the drum 140, independent from the drum 140, and then wash the clothes. The power is transmitted to the agitation unit 600 from the drive unit 200 and the agitation unit 600 may be repeatedly rotary by the power in a clockwise and counter-clockwise direction to create a strong water current in the drum 140.

Figure 3:
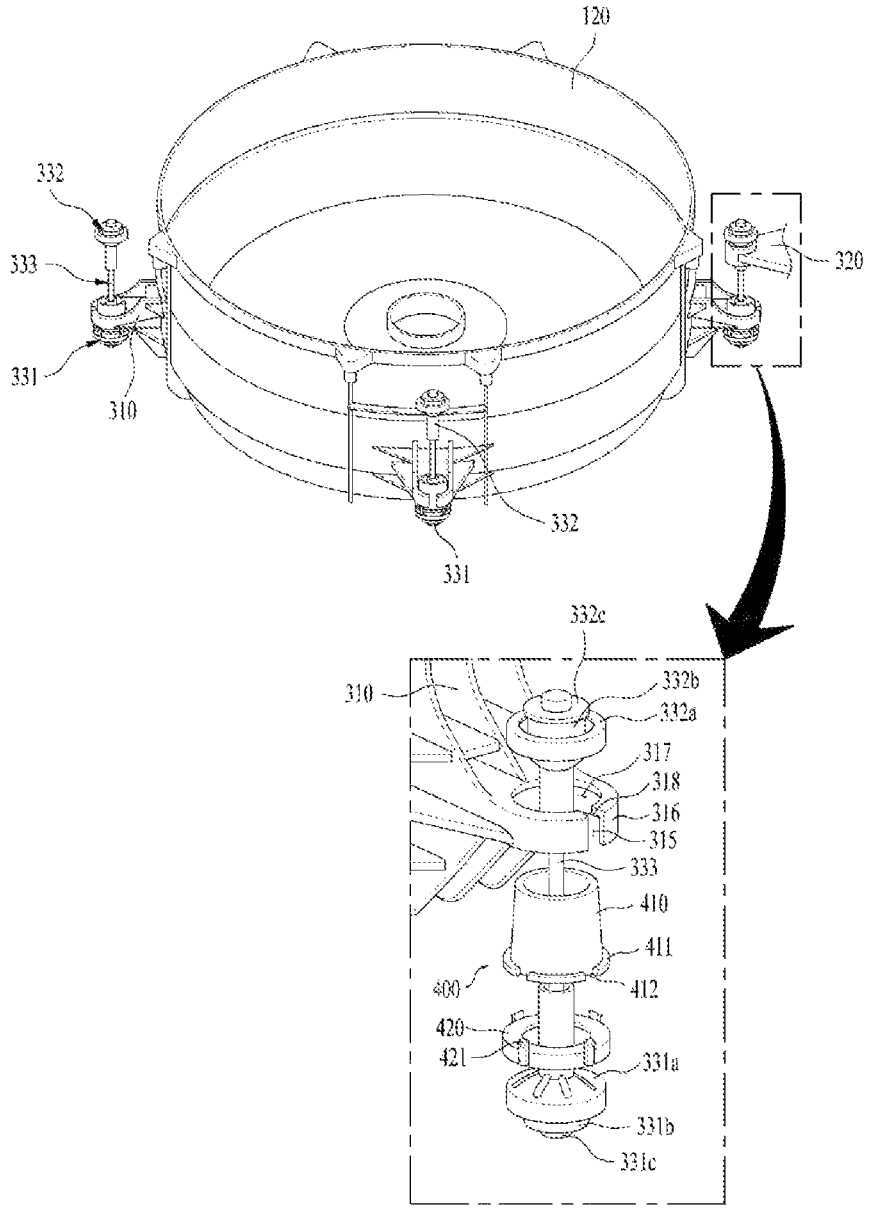
FIG. 3 is a diagram illustrating a basic structure of a support unit provided in the laundry apparatus.
Figure 4:
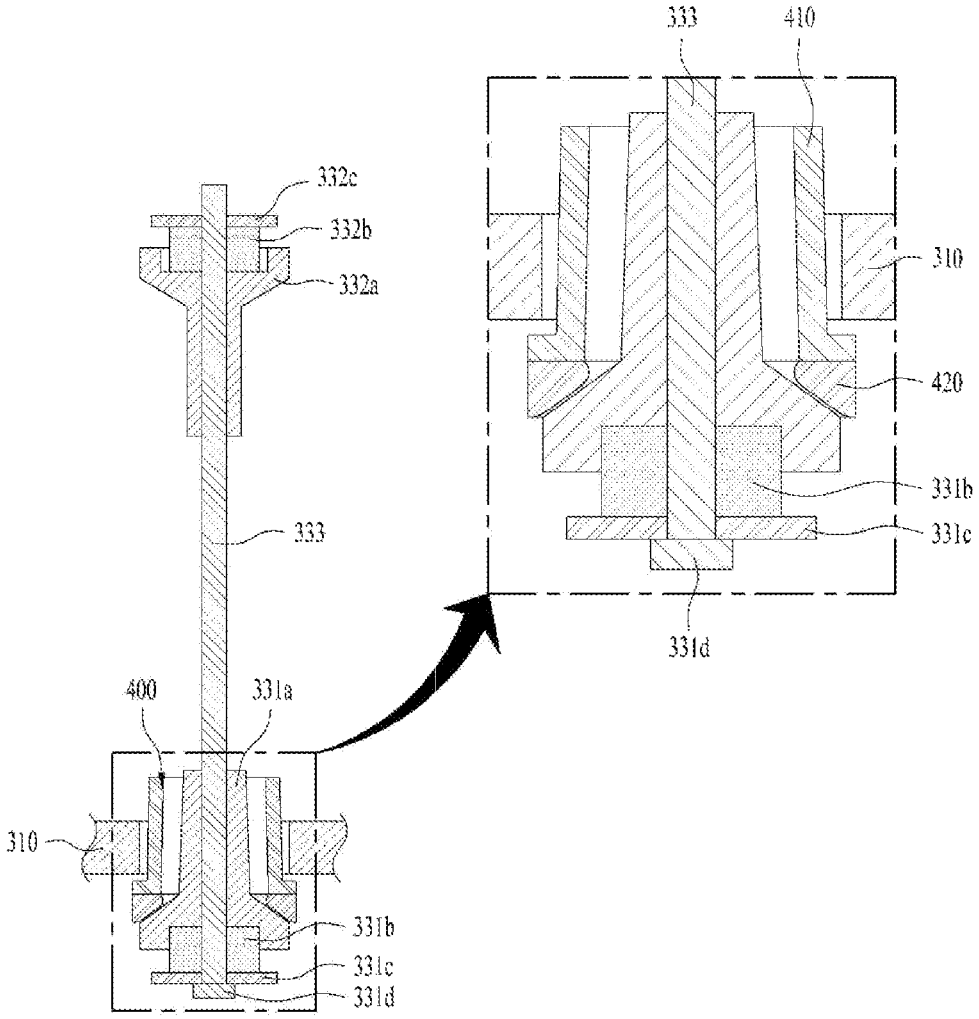
FIG. 4 is a sectional diagram of the support unit.

FIGS. 3 and 4 illustrate the structure of the support unit 300 which may omit the spring from the laundry apparatus.

The connection unit 330 may include a connection bar 333 having a preset length; and a first connection portion 331 and a second connection portion 332 that are provided in one end and the other end of the connection bar 333, respectively. At this time, the support unit 30 may include a flexible member 400 arranged in an outer side of the first connection portion 331 provided in one end of the connection bar 333.

Specifically, the connection bar 333 may be coupled to the first connection portion 331 and the second connection portion 332, after penetrating the flexible member 400.

In this instance, the first support portion 310 provided in an outer circumferential surface of the tub 120 may be formed as a coupling portion 316 having a coupling hole 317. The coupling portion 316 may be projected from the outer circumferential surface of the tub 120 towards an outer circumferential surface of the housing.

A predetermined area of the flexible member 400 may be arranged in the coupling hole 317 provided in the coupling portion 316 and the other area may be extended via the coupling hole 317 to be exposed outside. The outer circumferential surface of the flexible member 400 and an inner circumferential surface of the coupling hole 317 may keep a contacted state.

When the tub 120 is vibrated in a horizontal direction, the connection bar 333 and the first connection portion 331 are tilted horizontally and the outer circumferential surface of the first connection portion 331 contacts with the inner circumferential surface of the flexible member 400 to return to its original position. Accordingly, the horizontal vibration of the tub 120 may be damped by the flexible member 400.

Specifically, the first connection portion 331 coupled to a lower end of the connection bar 333 may be longer than the flexible member 400. In other words, both ends of the first connection portion 331 may be projected outside both ends of the flexible member 400. Accordingly, while the outer circumferential surface of the first connection portion 331 contacts with the inner circumferential surface of the flexible member 400 in case the tub 120 is vibrated in a horizontal direction, the vibration may be absorbed or damped.

Even when the connection bar 333 is tilted in a traverse direction by the horizontal-direction vibration of the tub 120, the connection bar 333 will not directly contact with the inner circumferential surface of the flexible member 400 but the outer circumferential surface of the first connection portion 331 surrounding the connection bar 333 will contact with the inner circumferential surface of the flexible member 400.

In this instance, the bracket provided as the coupling portion 316 may include a support rib 318 inwardly projected towards the center of the coupling hole 317. Also, a suspension rib 411 may be outwardly projected from a lower area of the flexible member 400. As one example, the suspension rib 411 may be projected outside in a circumferential direction of the flexible member 400 from the lower area of the flexible member 400. The suspension rib 411 may be integrally formed with the flexible member 400 and the support rib 318 may be integrally formed with the coupling portion 316.

When the flexible member 400 is arranged through the coupling hole 317, the suspension rib 411 may be arranged to contact with the support rib 318. In other words, when the first connection portion 331 is installed in the coupling portion 316, the suspension rib 411 of the flexible member 400 may be arranged to contact with the support rib 318 of the coupling portion 316. For instance, an upper surface of the suspension rib 411 may be arranged to contact with a lower surface of the support rib 318.

With such arrangement, the vibration may be damped by the suspension rib 411 of the flexible member 400 arranged in the lower area of the support rib 318 provided in the coupling portion 316 even when the tub 120 is vibrated in a longitudinal direction (or a vertical direction).

In addition, the first connection portion 331 provided in a lower end of the connection bar 333 may include a hemispheric body portion 331*a*. As one example, the first connection portion 331 may include a hemisphere-shaped first body portion 331*a* that is upwardly convex. More specifically, the first body portion 331*a* may be divided into one pipe-shaped portion accommodating the outer circumferential surface of the connection bar 331 and the other portion that is expanded in a hemispheric shape towards the lower end of the connection bar 331.

A position determination member 420 may be arranged between the flexible member 400 and the support surface 331*a* to determine the position of the flexible member 400. As one example, the position determination member 420 may be arranged between the lower area of the flexible member 400 and the first body portion 331*a* that is upwardly convex.

Specifically, one or more grooves 412 may be formed in the lower area of the flexible member 400. As one example, several grooves 412 may be formed in the suspension rib 411 of the flexible member 400 at preset intervals. One or more protrusions 421 may be formed in the position determination member 420, corresponding to the one or more grooves 412 formed in the flexile member 400. The one or more protrusions 421 may be inserted in the corresponding one or more grooves 412, respectively, to determine the position of the flexible member 400.

In other words, the flexible member 400 may be fixed to an upper area of the position determination member 420 arranged on the first body portion 331*a* of the first connection portion 331. Of course, alternatively, one or more protrusions may be formed in the lower area of the flexible member 400 and one or more grooves may be formed in the position determination member 420, such that the flexible member 400 can be fixed on the position determination member 420.

Meanwhile, the coupling portion 315 may include a cut-away portion 315. At this time, the protrusion 421 may be provided in a corresponding shape to the cut-away portion 315.

Accordingly, after the flexible member 400 is fixed on the position determination member 420 as descried above, the protrusions 421 of the position determination member 420 may be insertedly fitted to the cut-away portion 315 of the coupling portion 316 to prevent the flexible member 400 from being freely rotated.

Once the protrusions 421 of the position determination member 420 fitted in the cut-away portion 315 of the coupling portion 316, the first connection portion 331 may not be rotated in the coupling hole 317 of the coupling portion 316. In other words, the connection between the cut-away portion 315 and the fitted protrusion 421 may prevent the rotation of the connection portion 330.

The second connection portion provided in an upper end of the connection bar 333 may also include a hemispheric second body portion 332*a*. As one example, the second connection portion 332 may include a hemisphere-shaped second body portion 332*a* that is downwardly convex.

The first body portion 331*a* and the second body portion 332*a* may be formed in the same shape.

Such the downwardly-convex-hemispheric second body portion 332*a* may be disposed on a corresponding surface of the second support portion 320 provided in the housing.

In other words, a concave surface corresponding to the downwardly-convex-hemispheric second body portion 332*a* may be formed in the second support portion 320 of the housing. The downwardly-convex-hemispheric second body portion 332*a* may be arranged on such the concave surface.

As mentioned above, due to the flexible member 400, the support unit 300 is able to damp the horizontal-direction and vertical-direction vibration of the tub 120 even without the spring provided in the connection portion 300. In other words, when the tub 120 is vibrated in the traverse direction, the first connection portion 331 coupled to the connection bar 333 may contact with the inner circumferential surface of the flexible member 400 that is a cylinder-shape with a preset length and then the traverse-direction vibration may be damped.

When the tub 120 is vibrated in the vertical direction, the suspension rib 411 of the flexible member 400 arranged in the power area of the support rib 318 of the coupling portion 316 may damp the vertical direction.

Meanwhile, the first connection portion 331 may further include a first coupling portion 331*b* provided in an outer surface of a lower area of the first body portion 331*a*; and a first fixing portion 331*c* coupled to one end of the connection bar 333 and fixed to an exposed surface of the first coupling portion 331*b* to prevent the first coupling portion 331*b* from being separated.

The second connection portion 332 may further include a second coupling portion 332*b* provided in an outer surface or an upper area of the second body portion 331*b*; and a second fixing portion 331*c* coupled to one end of the connection bar 333 and fixed to an exposed surface of the second coupling portion 332*b*.

The first coupling portion 332*a* and the second coupling portion 332*b* are made of a flexible material so as to effectively damp the horizontal-direction vibration of the connection portion 330.

Referring to FIG. 4, a separation reinforcing portion 331*d* may be further provided in an outer surface of the first fixing portion 331*c*. The separation reinforcing portion 331*d* is coupled to one end of the connection portion 333 to prevent the separation of the first fixing portion 331*c* and effectively support the load of the tub 120.

The fixable member 400 may absorb or damp the vibration of the connection portion 330, while contacting with the first support portion 310.

In this instance, the support unit 300 includes no spring such that it may be difficult for the support unit 300 to damp a strong vibration temporarily. Accordingly, the bottom or lateral surface of the tub 120 might collide against the bottom or lateral surface of the housing provided in the cabinet or drawer 130. Also, when the volume of the tub 120 is expanded, more water could be held in the tub 120 and the average load of the tub 120 could be increased during the washing. Accordingly, the width of the vertical-direction vibration might increase or abnormal vibration might occur. The coupling of the connection portion 330 supporting the tub 120 might be released or damaged only to weaken the durability.

To prevent that, the support unit 300 of the laundry apparatus 100 may further include a reinforcement unit 500 provided to prevent the position of the connection portion from being variable by the contact or friction with the surface of the connection portion.

The reinforcement unit 500 may closely contact with or coupled to the surface of the connection portion 330 so as to prevent not only the absolute position of the connection portion 330 but also the relative positions of the first connection portion 331, the second connection portion 332 and the connection bar 333 from being variable.

Moreover, the reinforcement unit 500 may be provided reinforce the support unit 300 to damp even the longitudinal direction vibration of the tub 120 more effectively.

Figure 5A:
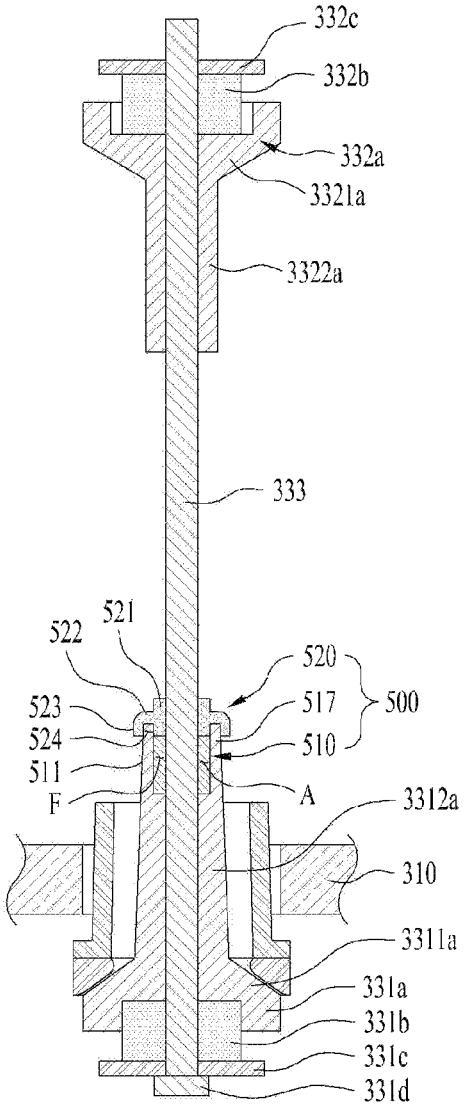
FIGS. 5A and 5B are diagrams illustrating a damper unit configured to damp the vibration of the support unit.
Figure 5B:
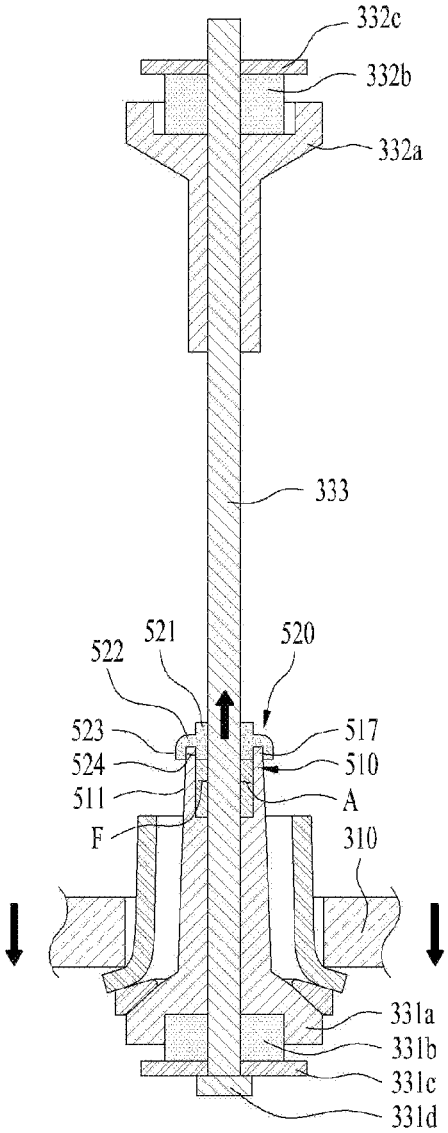

FIGS. 5A and 5B are diagrams illustrating one embodiment of the support unit 300 in which the reinforcement unit 500 is provided.

Referring to FIG. 5A, the reinforcement unit 500 may prevent at least one of the first and second connection portions 331 and 332 from being movable from the position of being coupled to the connection bar 333.

Specifically, the connection bar 333, the first connection portion 331 and the second connection portion 332 may be provided as separate pieces and coupled to each other, such that it may be quite vulnerable to the longitudinal-direction vibration. If the spring damper is omitted, the first connection portion 331 and the second connection portion 332 may support the load of the tub 120.

At this time, when the vibration of the tub 120 occurs, the coupling positions of the first connection portion 331 and the second connection portion 332 with respect to the connection bar 333 are changeable and then separated such that the tub 120 might fall.

Accordingly, the reinforcement unit 500 may prevent the relative positions of the first and second connection portions 331 and 332 and the connection bar 333 from being changed so as to secure the durability of the connection portion 330.

Specifically, the reinforcement unit 500 may include a friction portion F that may directly cause friction with the connection bar 333 by contacting with the outer circumferential surface of the connection bar 333; and a reinforcing pocket 510 having an accommodation space A for accommodating the friction portion F. The friction portion F may be made of a friction material.

The friction portion F may provide the connection bar 333 with the friction force when the connection bar 333 is likely to move, so as to prevent the connection bar 33 from being moved.

The reinforcing pocket 510 may include a first reinforcing pocket 511 provided in at least one inner circumferential surface of the first and second connection portions 331 and 332. Specifically, the first reinforcing pocket 510 may be provided in at least one of an upper area of the first connection portion 331 or a lower area of the second connection portion 332. In other words, the first reinforcing pocket 511 may be provided in at least one of the upper area of the first body portion 331*a* and a lower area of the second body portion 332*a*.

An opening of the first reinforcing pocket 511 is exposed outside the connection portion 330 to facilitate the injection, charging and replacing of the friction portion F.

The friction portion F may include a highly viscous liquid or a strong friction force material. Examples of the friction material may include grease, felt, rubber and the like.

Meanwhile, the reinforcement unit 500 may further include a cover 520 provided to prevent the friction portion F filled in the reinforcing pocket 510 from discharged or separated from the reinforcing pocket 510. Accordingly, even when an open surface of the reinforcing pocket 510 is exposed outside, the cover 520 may close the open surface and prevent the discharge of the friction portion F.

The connection bar 333 may be coupled to the connection bar 333 there through. In other words, the cover 520 may be attached to an outer circumferential surface of the connection bar 333 and coupled to the open surface of the reinforcing pocket 510 at the same time. The cover 520 may be also made of a material having a relatively high frictional force. Examples of such a material may include rubber and resin.

The cover 520 may include a cover body 521 coupled to the outer circumferential surface of the connection bar 333 to accommodate the cover body; an opening/closing portion 522 extended from the cover body 521 outside to close the open or exposed surface of the reinforcing pocket 510; and a coupling rib 523 projected from one end of the opening/closing portion 522 to be coupled to the outer circumferential surface of the reinforcing pocket 510.

An accommodating groove 524 may be provided between the cover body 521 and the coupling rib 523 and the open surface of the reinforcing pocket 510 may be inserted in the accommodating groove 524. The gap of the accommodating groove 524 may be equal to or smaller than the thickness of the reinforcing pocket 510 to facilitate the forcible fitting.

Referring to FIG. 5B, when the vibration of the tub 120 is generated or a sudden load is applied, the first support portion 310 may press the first connection portion 331 downwardly and the first connection portion 331 may receive the external force applied downwardly from the connection bar 333.

At this time, the flexible member 400 may be pressed down to absorb the vibration and load and the first coupling portion 311*b* may be also pressed down to absorb the vibration and load.

Moreover, the outer circumferential surface of the connection bar 333 has friction with the friction portion F and damps the vibration that is generated upside and downside.

If the first connection portion 331 and the second connection portion 332 where the reinforcement unit 500 is provided try to move in the longitudinal direction with respect to the connection bar 333, the friction portion F may provide a strong static friction force or kinetic friction force to the connection bar 333. Accordingly, the first or second connection portion 331 or 332 having the reinforcement unit 500 may be prevented from moving from the connection bar 333 in advance.

As shown in FIGS. 5A and 5B, the first connection portion 32 may relatively support the more load of the tub 120 and the longitudinal-direction vibration is focused on the first connection portion 332 such that the reinforcement unit 500 may be provided in the first connection portion 331. As mentioned above, it is not excluded that the reinforcement unit 500 is provided in the second connection portion 332.

The cover 520 may also have the coupling force with the first reinforcing pocket 511 and the friction force. The cover 520 may damp the vibration of the connection bar 333 and contribute to preventing the position of the first or second connection portion 331 or 332 from being changed.

Accordingly, the vibration and load generated in the tub 120 may be effectively damped or absorbed by the reinforcement unit 500 or the flexible member 400, even unless the spring is provided. Even if a temporary strong load is generated, the relative positions of the connection bar 333 and the first and second connection portions 331 and 332 may be prevented from being changed.

Thus, the collision between the tub 120 and the housing (the cabinet 110 or the drawer 130) may be prevented and even the durability of the connection portion 330 may be secured sufficiently.

Different from what is mentioned above, the first reinforcing pocket 511 may be provided as an open groove formed in the inner circumferential surface of the first body portion 331*a* and the second body portion 332*a* such that the friction portion F may be attached or closely contact with the connection bar 333.

Figure 6:
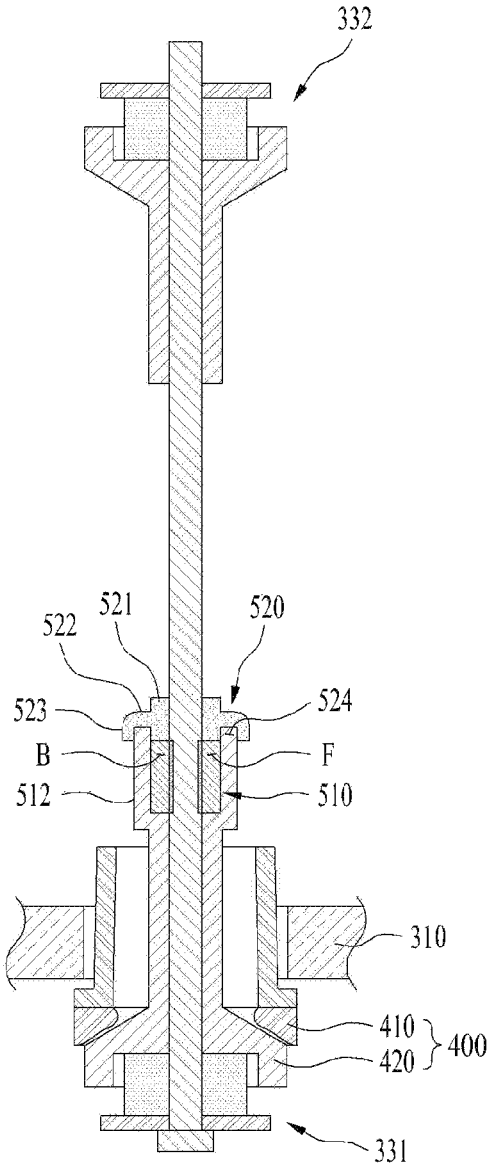
FIG. 6 is a diagram illustrating another embodiment of the support unit.

FIG. 6 is a diagram illustrating another embodiment of the reinforcement unit 500.

The reinforcing pocket 510 may include a second reinforcing pocket 512 extended from at least one of the upper end of the first connection unit 331 or the lower end of the second connection portion 332 to accommodate the connection bar 333. The second reinforcing pocket 512 may be integrally formed with at least one of the first and second connection portions 331 and 332.

Accordingly, the second reinforcing pocket 512 may be provided with a sufficient length or volume to secure the friction force with the connection bar 333, without the limitation to the diameter, thickness and length of the first or second body portion 331 or 332*b*.

Referring to FIG. 6, the reinforcing pocket 510 may include a second reinforcing pocket 512 of which a diameter is larger than the upper end of the first connection portion 331 and the lower end of the second connection portion 332. In this instance, the reinforcement unit 500 may further include a cover 520 coupled to the reinforcing pocket to prevent the discharging of the friction material. The cover 520 may be formed in the same shape with the cover coupled to the first reinforcing pocket 512, except the opening/closing portion 522 of which a diameter is larger than the diameter of the opening/closing portion provided in the first reinforcing pocket.

The second reinforcing pocket 512 may be taller than the first reinforcing pocket 511. The second reinforcing pocket 512 has a more expanded space B in which the friction portion F is filled and the friction force with the connection bar 333 may be reinforced more.

Accordingly, the second reinforcing pocket 512 may fix the relative position by reinforcing the coupling force between the first or second connection portion 331 or 332 with the connection bar 333. Also, the longitudinal-direction vibration may be damped more effectively.

Figure 7A:
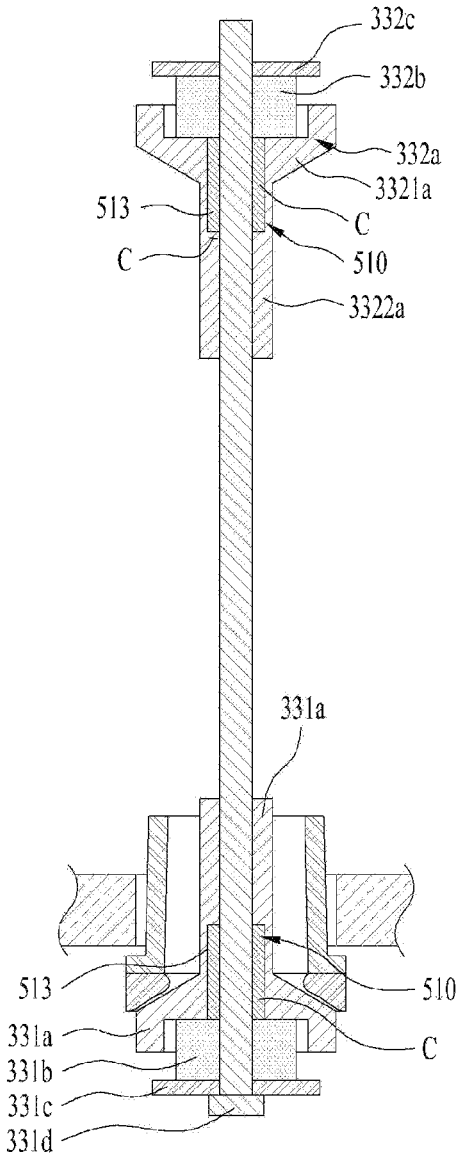
FIGS. 7A and 7B are diagrams illustrating a further embodiment of the support unit.
Figure 7B:
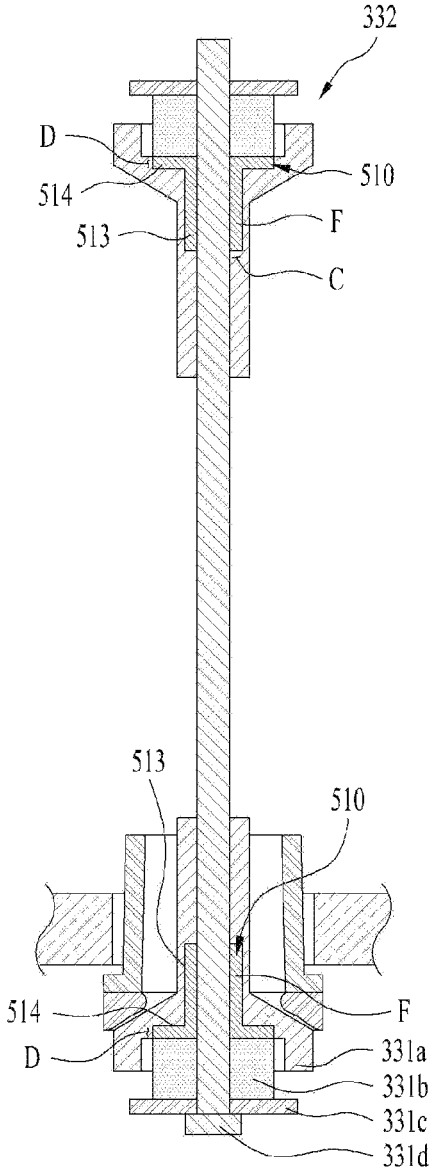

FIGS. 7A and 7B are diagrams illustrating a further embodiment of the reinforcement unit 500.

Referring to FIG. 7A, as mentioned above, the connection bar 333 may be provided through the first connection portion 331 and the second connection portion 332. The reinforcing pocket 510 may include a third reinforcing pocket 513 provided in the lower area of the first connection portion 331 or the upper area of the second connection portion 332.

In other words, the reinforcing pocket 510 may be provided in both ends, not a middle area of the connection bar 333. It may be provided in an inner circumferential surface of at least one of the first and second body portions 331*a* and 332*b*.

Accordingly, the sealing force between the friction portion F filled in the third reinforcing pocket 513 and the connection bar 333 may be strengthened. The movement range of the connection bar 333 may become wider towards the ends. The friction portion F is attached to one of the ends of the connection bar 333 such that the relative motion between the connection bar 333 and the first or second connection portion 331 or 332 may be prevented in advance.

The internal space C of the third reinforcing pocket 513 may be corresponding to the space A of the first reinforcing pocket 511.

Meanwhile, to prevent the discharging of the friction portion F, the first coupling portion 331*b* and the second coupling portion 332*b* may be provided in close contact with the lower end of the first connection portion 331 and the upper end of the second connection portion 332, respectively. In other words, the first coupling portion 331*b* and the second coupling portion 332*b* may be made of a flexible material only to close the open area of the third reinforcing pocket 513. The reinforcement unit 500 may include no cover 520.

Referring to FIG. 7B, the friction portion F may be filled from the inside of the third reinforcing pocket 513 even to one surface of at least one of the first and second coupling portions 331*b* and 332*b*. In other words, the friction portion F may be filled not only in the third reinforcing pocket 513 but also to the exposed surfaces or ends of the first and second coupling portions 331*b* and 332*b* over the third reinforcing pocket 513.

Specifically, the reinforcement unit 500 may have a first body portion 331*a* and a concave space provided in an outer circumferential surface of the second body portion 332*a* to accommodate the first coupling portion and the second coupling portion. The reinforcement unit 500 may further include a fourth reinforcing pocket 514 provided in the concave space.

The fourth reinforcing pocket 514 may have an accommodating space D.

Accordingly, the friction portion F may provide the friction force with the connection bar 33 and also the contact force with at least one of the first and second coupling portions 331*b* and 332*b* by using viscosity. The overall coupling force of the connection portion 330 may be strengthened and even the longitudinal-direction vibration may be also damped effectively.

Figure 8:
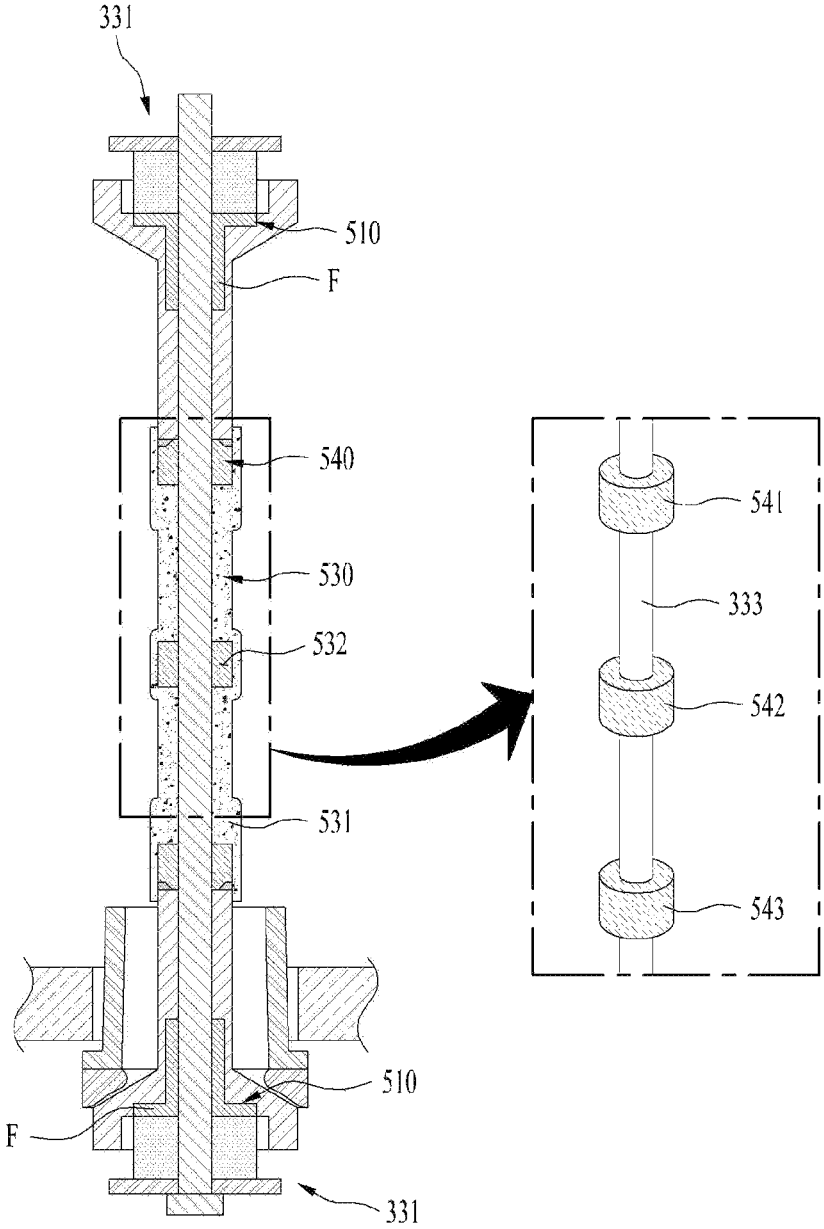
FIG. 8 is a diagram illustrating a still further embodiment of the support unit.

FIG. 8 is a diagram illustrating the last embodiment of the reinforcement unit 500.

The reinforcement unit 500 may include one or more dampers coupled to the outer circumferential surface of the connection bar 333; and a case 530 provided to accommodate the damper 540 and coupled to the connection bar 333.

The damper 540 may be made of a material having a high elasticity and friction force (e.g., rubber or the like) and formed in a ring shape to be coupled to the outer circumferential surface of the connection bar 333. The case 530 may be made of resin or reinforced plastic.

A plurality of dampers 540 may be provided along the connection bar 330 and the case 530 may be connected with at least one of the first and second connection portions 331 and 332 and provided to connect the first and second connection portions 331 and 332 with each other along the connection bar 333. The case 530 may fix the position of the damper 540 to prevent the relative movement between the connection bar 333 and the damper 540.

Specifically, the case 530 may include a case body 531 that may be connected with the first connection portion 331 and the second connection portion 332; and a fitting space 532 provided in the case body 531 to accommodate each of the dampers or forcibly fitted.

As one example, when the damper 540 includes a first damper 541, a second damper 542 and a third damper 543 that are provided along the longitudinal direction of the connection bar 333, the case 530 may have the first damper 541, the second damper 542 and the third damper 543 to be fitted in the fitting space 532 to make the dampers closely contact with the connection bar 333.

At this time, when the longitudinal-direction is generated in the tub 120, the first damper 541, the second damper 542 and the third damper 543 may contribute to the damping of the vibration. Also, when the connection bar 333 tries to relatively move with respect to the first connection portion 331, the second connection portion 332 and the case 530, the damper 540 may prevent the movement of the connection bar 333.

Figure 9:
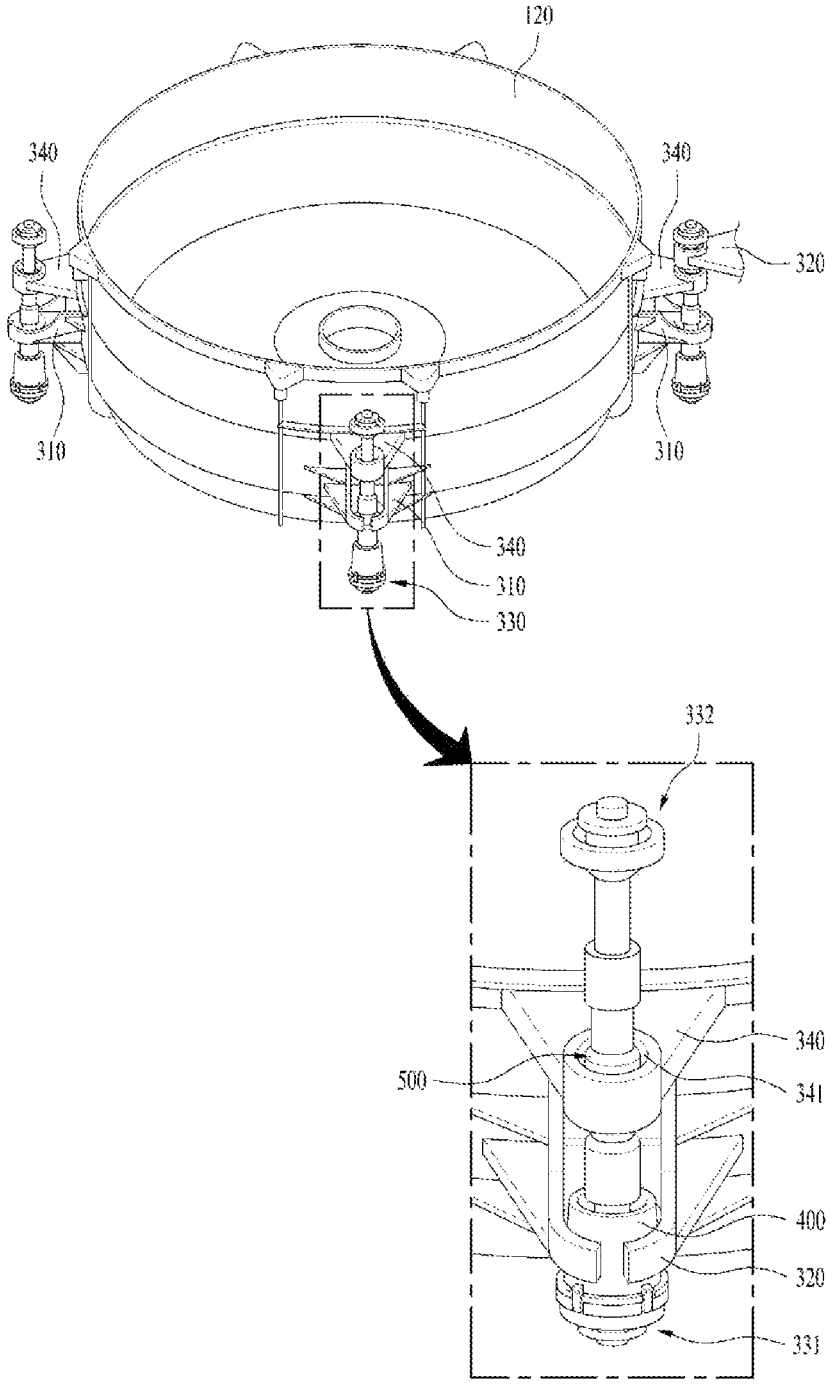
FIG. 9 is a diagram illustrating the last embodiment of the support unit.

FIG. 9 illustrates one embodiment to strengthen the damping force of the support unit 300 and secure the durability of the support unit 300.

The support unit 300 may further include a third support portion 340 projected from the tub 120 or the housing of the cabinet 110 or the drawer 130 to connectedly accommodate the reinforcement unit 500.

As shown in FIG. 9, the third support portion 340 may be projected from the lateral surface of the tub 120. Alternatively, the third support portion 340 may be projected from an inner wall of the housing only if it is able to fix the connection portion 330 or the reinforcement unit 500.

The third support portion 340 may be provided between the third connection portion 331 and the second connection portion 332 to be coupled to the connection portion 330.

In addition, the third support portion 340 may fix the reinforcement unit 500 to prevent the reinforcement unit 500 from moving upwardly or downwardly, only to fix or support the connection portion 330.

Meanwhile, all of the embodiments mentioned above may be applied to the reinforcement unit 500.

For instance, the third support portion 340 may include a fixing hole 341. The reinforcing pocket 510 or the case 530 may be coupled to the fixing hole 341. In addition, the reinforcing pocket 510 or the case 530 may be forcibly fitted in the fixing hole 341.

Accordingly, the third support portion 340 may fix the reinforcement unit 500 and prevent the longitudinal-direction position of the reinforcement unit 500 from being changed such that the position of the reinforcement unit 500 may be fixed in close contact with the connection bar 333.

As a result, the third support portion 340 may damp the longitudinal-direction vibration of the support unit 300 effectively and share the load of the tub 120. Accordingly, the movement of the first or second connection portion 331 or 332 from the connection bar 333 may be prevented effectively.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A laundry apparatus comprising:

a housing;

a tub provided in the housing and configured to receive water;

a drum rotatably provided in the tub and configured to receive clothes;

a drive unit provided at a lower portion of the tub and configured to rotate the drum; and a plurality of support units that are provided at the housing, that are configured to support the tub, and that are configured to reduce vibration of the tub, wherein each of the plurality of support units extends in a direction parallel to a height direction of the tub, wherein each of the plurality of support units comprises:

a first support portion provided at the tub, a second support portion provided at the housing above the first support portion, a connection portion that connects the first support portion to the second support portion, and a reinforcement unit that is configured to contact a surface of the connection portion and that is configured to restrict movement of the connection portion, wherein the connection portion comprises:

a first connection portion located at the first support portion and configured to support the first support portion, a second connection portion coupled to the second support portion and configured to support the second support portion, and a connection bar that connects the first connection portion and the second connection portion to each other, wherein the reinforcement unit comprises:

a friction portion that includes a friction material and contacts an outer circumferential surface of the connection bar, a reinforcing pocket that is a part of the first connection portion or the second connection portion and defines an accommodating space configured to accommodate the friction material, the reinforcing pocket having an open surface facing an outside of the first connection portion or the second connection portion, and a cover that is coupled to the reinforcing pocket and covers the open surface, the cover being configured to restrict a leakage of the friction material from the reinforcing pocket, and wherein the reinforcing pocket extends from at least one of an upper end of the first connection portion or a lower end of the second connection portion and accommodates at least a portion of the connection bar.

2. The laundry apparatus of claim 1, wherein the reinforcement unit is configured to, based on at least one of the first connection portion or the second connection portion being coupled to the connection bar at a coupling position, restrict movement of at least one of the first connection portion or the second connection portion from the coupling position.

3. The laundry apparatus of claim 1, wherein the accommodating space of the reinforcing pocket is defined by an inner circumferential surface of the first connection portion or an inner circumferential surface of the second connection portion.

4. The laundry apparatus of claim 1, wherein the reinforcing pocket is defined at at least one of an upper portion of the first connection portion or a lower portion of the second connection portion.

5. The laundry apparatus of claim 4, wherein the connection bar penetrates the cover in a state in which the cover is coupled to the reinforcing pocket.

6. The laundry apparatus of claim 1, wherein a diameter of the reinforcing pocket is greater than a diameter of the upper end of the first connection portion and a diameter of the lower end of the second connection portion.

7. The laundry apparatus of claim 1, wherein the connection bar penetrates the first connection portion and the second connection portion, and wherein the reinforcing pocket is defined at a lower portion of the first connection portion or an upper portion of the second connection portion.

8. The laundry apparatus of claim 7, wherein the connection portion comprises:

a first coupling portion that is coupled to the lower portion of the first connection portion, that is in contact with the first connection portion, and that is configured to restrict a leakage of the friction material from the first connection portion; and a second coupling portion that is coupled to the upper portion of the second connection portion, that is in contact with the second connection portion, and that is configured to restrict a leakage of the friction material from the second connection portion.

9. The laundry apparatus of claim 8, wherein the friction portion extends from an inside of the reinforcing pocket to at least one of the first coupling portion or the second coupling portion.

10. The laundry apparatus of claim 2, wherein the reinforcement unit comprises:

one or more dampers coupled to an outer circumferential surface of the connection bar; and a case that is coupled to the connection bar and that accommodates the one or more dampers.

11. The laundry apparatus of claim 10, wherein each of the plurality of support units further comprises:

a third support portion that extends from the tub or the housing and that is configured to accommodate the reinforcement unit.

12. The laundry apparatus of claim 11, wherein the third support portion is coupled to the reinforcement unit at a position between the first support portion and the second support portion, and is configured to restrict a movement of the reinforcement unit in the height direction of the tub.

13. The laundry apparatus of claim 1, wherein each of the plurality of support units further comprises:

a third support portion that extends from the tub or the housing and that is configured to accommodate the reinforcement unit.

14. The laundry apparatus of claim 13, wherein the third support portion is coupled to the reinforcement unit at a position between the first support portion and the second support portion, and is configured to restrict a movement of the reinforcement unit in the height direction of the tub.

15. The laundry apparatus of claim 10, wherein the case extends along the connection bar in the height direction of the tub and surrounds an entire portion of the connection bar between the first connection portion and the second connection portion.

16. The laundry apparatus of claim 9, wherein the friction portion extends from the inside of the reinforcing pocket in the height direction of the tub to at least one of an upper surface of the first coupling portion or a lower surface of the second coupling portion, and wherein the friction portion extends radially outward from at least one of the upper surface of the first coupling portion or the lower surface of the second coupling portion.

17. The laundry apparatus of claim 3, wherein the reinforcement pocket is defined between the outer circumferential surface of the connection bar and the inner circumferential surface of at least one of the first connection portion or the second connection portion.

18. The laundry apparatus of claim 1, wherein the friction material comprises a viscous liquid.

19. The laundry apparatus of claim 1, wherein the first support portion is attached to an outer surface of the tub and receives at least a portion of the first connection portion.

20. A laundry apparatus comprising:

a housing;

a tub provided in the housing and configured to receive water;

a drum rotatably provided in the tub and configured to receive clothes;

a drive unit provided at a lower portion of the tub and configured to rotate the drum; and a plurality of support units that are provided at the housing, that are configured to support the tub, and that are configured to reduce vibration of the tub, wherein each of the plurality of support units extends in a direction parallel to a height direction of the tub, wherein each of the plurality of support units comprises:

a first support portion provided at the tub, a second support portion provided at the housing above the first support portion, a connection portion that connects the first support portion to the second support portion, and a reinforcement unit that is configured to contact a surface of the connection portion and that is configured to restrict movement of the connection portion, wherein the connection portion comprises:

a first connection portion located at the first support portion and configured to support the first support portion, a second connection portion coupled to the second support portion and configured to support the second support portion, a third support portion that extends from the tub or the housing and that is configured to accommodate the reinforcement unit, and a connection bar that connects the first connection portion and the second connection portion to each other, wherein the reinforcement unit comprises:

a friction portion that includes a friction material and contacts an outer circumferential surface of the connection bar, a reinforcing pocket that is a part of the first connection portion or the second connection portion and defines an accommodating space configured to accommodate the friction material, the reinforcing pocket having an open surface facing an outside of the first connection portion or the second connection portion, and a cover that is coupled to the reinforcing pocket and covers the open surface, the cover being configured to restrict a leakage of the friction material from the reinforcing pocket, and wherein the third support portion is coupled to the reinforcement unit at a position between the first support portion and the second support portion and configured to restrict a movement of the reinforcement unit in the height direction of the tub.

* * * * *